US010737813B2

(12) United States Patent
Deantoni et al.

(10) Patent No.: US 10,737,813 B2
(45) Date of Patent: Aug. 11, 2020

(54) PACKAGING MACHINE

(71) Applicant: NESTEC S.A., Vevey (CH)

(72) Inventors: Frederic Deantoni, Orbe (CH); Cristina Torok, Renens (CH)

(73) Assignee: Societe des Produits Nestle S.A., Vevey (CH)

( * ) Notice: Subject to any disclaimer, the term of this patent is extended or adjusted under 35 U.S.C. 154(b) by 236 days.

(21) Appl. No.: 15/580,471

(22) PCT Filed: Jun. 21, 2016

(86) PCT No.: PCT/EP2016/064262
§ 371 (c)(1),
(2) Date: Dec. 7, 2017

(87) PCT Pub. No.: WO2016/207138
PCT Pub. Date: Dec. 29, 2016

(65) Prior Publication Data

US 2018/0162574 A1 Jun. 14, 2018

(30) Foreign Application Priority Data

Jun. 22, 2015 (EP) ..... 15173161

(51) Int. Cl.
*B65B 9/20* (2012.01)
*B65B 9/213* (2012.01)
*B65B 39/00* (2006.01)

(52) U.S. Cl.
CPC ..... *B65B 9/2042* (2013.01); *B65B 9/20* (2013.01); *B65B 9/2049* (2013.01); *B65B 9/213* (2013.01); *B65B 39/002* (2013.01)

(58) Field of Classification Search
CPC ..... B65B 9/20; B65B 9/2042; B65B 9/213; B65B 9/2049; B65B 51/303; B65B 39/002
USPC ..... 53/451, 551, 370.2, 371.8, 372.6
See application file for complete search history.

(56) References Cited

U.S. PATENT DOCUMENTS 4,587,795 A * 5/1986 Yamashita ..... B65B 9/2042 222/504
6,526,733 B1 * 3/2003 Schellenberg ..... B65B 9/2042 493/11
2011/0206812 A1 * 8/2011 Elias ..... B65B 1/22 426/124

FOREIGN PATENT DOCUMENTS

| | | |
|---|---|---|
| DE | 2732917 | 4/1978 |
| DE | 4431933 | 3/1996 |
| EP | 0346053 | 12/1989 |
| NL | 1028632 | 9/2006 |

OTHER PUBLICATIONS

Anonymous "Vertical-form-fill seal solids infeed drop gate" Research Disclosure, Mason Publications, Hampshire, GB, Aug. 2000, vol. 436, No. 13, 3 pages.

* cited by examiner

*Primary Examiner* — Hemant Desai
*Assistant Examiner* — Veronica Martin
(74) *Attorney, Agent, or Firm* — K&L Gates LLP

(57) ABSTRACT

A packaging machine and apparatus for forming and filling plastic bags for containing dry food products such as cereals or the like. The invention comprising a product dispensing port over which a film enveloping the port may pass and an inner passage through which a product may be dispensed. The dispensing port comprises a pair of opposing flaps pivotally coupled to the outlet of the dispensing port which are movable between an open and a closed position.

17 Claims, 9 Drawing Sheets

PACKAGING MACHINE

TECHNICAL FIELD

The invention relates to a packaging machine. In particular, the invention relates to a packaging machine for dry food products such as cereals or the like.

CROSS REFERENCE TO RELATED APPLICATIONS

The present application is a National Stage of International Application No. PCT/EP2016/064262, filed on Jun. 21, 2016, which claims priority to European Patent Application No. 15173161.9, filed on Jun. 22, 2015, the entire contents of which are being incorporated herein by reference.

BACKGROUND

Food products such as breakfast cereals or cereal snacks are commonly in the form of dry flakes or similar shapes. The products are stored and conveyed to customers in cardboard boxes carrying product name, advertising and regulatory information such as ingredients.

The cereal products themselves are contained in plastic bags within the cardboard box which serves to prolong shelf life and prevent infestation.

The cereal products are loaded into the plastic bags by packaging machines which form a plastic bag from a roll of suitable plastic material. The bag is formed in such a packaging or gusseting machine and once formed the cereal product can be dispensed into the bag and eventually loaded into the cardboard box.

During the process, the product is dropped in the bag from a supply tube. If the quantity of cereal product (for example) to be packed is important or if the shape of the cereal product presents sharp edges like in square pillows, the plastic film can be damaged. This may cause slits in the bags leading to quality issues and reduction of the shelf-life of the product.

To address these problems manufacturers have the choice of increasing the thickness of the film or alternatively of reviewing the complete process.

The present inventors have recognised that increasing film thickness has disadvantages in terms of manufacturing costs and material usage. On the other hand, reviewing the complete packaging process needs important financial investments and time.

It is therefore an object of the invention to provide a packaging apparatus and method that allows cereal packaging to be improved and manufacturing costs reduced.

SUMMARY OF THE INVENTION

In a first aspect of the invention there is provided a bag forming and filling apparatus comprising a product dispensing port, said product dispensing port having an outer surface over which a film enveloping the dispensing port may pass and an inner passage through which a product may be dispensed; the apparatus further comprises a bag gusseting and sealing arrangement proximate a vertically lower outlet of the product dispensing port and arranged to selectively engage with the outer surface of the film enveloping the dispensing port; wherein the dispensing port further comprises a pair of opposing flaps pivotally coupled to the outlet of the dispensing port, said opposing flaps having outer surfaces over which the film may pass and inner surfaces arranged to support a product to be dispensed; and wherein the opposing flaps are movable between a first open position in which a product is dispensed and a second closed position in which product is prevented from being dispensed.

Thus, according to the invention a bag forming and filling apparatus is provided in which an outlet port comprising a pair of opposing and pivotally mounted flaps hinged to a lower end of the outlet port. Importantly, the outlet port and the associated flaps are arranged in use within a plastic film surrounding and enveloping the port i.e. a plastic film sleeve or tube passes over the outside of the outlet port.

Advantageously as the bag is formed the opposing flaps rotate to create a barrier or shield which protects the plastic film from damage as the product is released into the bag.

In conventional machines, a lower gusset of a plastic bag is formed and food product is released and falls into the bag and against the formed gusset. The problem is that for sharp or heavy products the plastic material can be damaged, particularly when the drop height from weigher to bagger is large. To prevent bag damage it is necessary to increase the thickness of the plastic material.

Accordingly, the present invention overcomes these problems with the prior art with a novel outlet port arrangement which cooperates with gusseting blades as described herein. It is in fact counterintuitive to incorporate movable flaps within an envelope of plastic film which forms a plastic bag.

Furthermore, the machine according to the invention provides highly consistent gusseted and filled bags, removes shelf-life issues due to slitting of the bags and may be conveniently fitted to existing machinery because of the arrangement of rotatable flaps and outlet port.

The opposing flaps may be coupled to the dispensing port by means of hinge arrangements such that rotation of each respective flap brings distal edges of each flap together in the second closed position.

A hinge arrangement allows gravity to be used to return the flaps to a vertical orientation and gusseting blades or members to bring the flaps into proximity or contact in the closed position.

In the closed position the upper surface of the flaps and generally facing upwards towards a product supply tube and act as a surface onto which the falling or discharged product can contact/impact. The hinge provides a mechanically simple and reliable arrangement for this movement.

Each opposing flap may be generally rectangular having a first edge proximal the hinge and rotatably coupled to the dispensing port and a second distal edge opposed to the proximal edge and arranged to move in an arc towards the opposing flap.

As the plastic film passes over the outside of the outlet port and flaps a rectangular cross-section can be conveniently formed which allows for a bag shape that fits a rectangular box. As the rectangular flaps rotate about the hinge the distal edges (distal that is from the respective hinge) of each flap approached the opposing flap until they are proximate each other or alternatively in contact.

The second opposing distal edge may have a central substantially straight region and two truncated regions at either end of said distal edge. Thus, each flap is provided with a 'cut-away' profile on either end which may advantageously correspond to the shape of a gusseting member or blade that forms a gusset. Providing a cut-away portion allows a gusseting blade to be brought into close proximity to the outlet port without interfering with the arcuate movement of the opposing flaps. This advantageously allows a variety of gusset depths to be formed without preventing the operation of the protective opposing flaps according to the invention.

Thus, the truncated or 'cut-away' regions may be arranged to receive a portion of a gusseting member when a gusseting member is in a gusset forming position and when the opposing flaps are in a closed position.

The bag gusseting and sealing arrangement may also comprise a pair of horizontally movable upper gusseting members movable from a retracted position to an extended position wherein distal portions of each member are positioned between the opposing flaps. This advantageously allows the gusset to be formed in cooperation with the opposing flaps.

Specifically, movement of the gusseting members or blades between the opposing flaps causes the gusseting members to abut against the plastic film enveloping the outlet port and flaps. Further movement causes tension in the plastic material which applies a force to the rotatably mounted flaps causing them to rotate towards each other.

Thus, the pair of upper gusseting members can be arranged to move towards each other simultaneously and to contact the outer surface of the film to cause the film enveloping the opposing flaps to be drawn inwards and against the outer surfaces of the opposing flaps.

The gusseting and sealing arrangement may further advantageously comprise a pair of opposing and horizontally movable elongate sealing jaws arranged to move from a first retracted position to a second extended position in which the opposing jaws are in abutment with each other.

The direction of movement of the sealing jaws is perpendicular to the direction of movement of the gusseting members such that the gusseting members can form the gussets at the sides of the generally rectangular bag and the sealing member can create seals perpendicular to the gussets and forming the ends of each bag.

The sealing jaws may thus be arranged to move together in opposing directions so as to contact the outer surface of film and to cause the film enveloping the opposing flaps to be drawn inwards and against the outer surfaces of the opposing flaps. A heating source may be incorporated into one or both of the sealing jaws so as to cause the plastic film to be heated between the jaws. Thus, an elongate seal can be formed defining the sealed end of a bag.

The sealing jaws and gusseting blades may advantageously be operated simultaneously and at predetermined start times. This can minimise the time required to create the gussets and seal before product can be released.

An upper surface of the opposing sealing jaws is advantageously positioned in a plane which is vertically beneath the lower edges of the opposing flaps when in a closed position. Thus, as the sealing jaws move together they pass beneath the opposing flaps with a predetermined clearance therebetween.

Movement of the sealing jaws engages with the outer surface of the film enveloping the outlet port and flaps and draws the flaps towards each other (in the same way that the gusseting members caused tension in the plastic film in a perpendicular direction).

The predetermined clearance between the lower edge of the opposing flaps and the upper surface of the sealing jaws can be selected so as to control the amount of movement of the opposing flaps.

The cross-sectional shape of the product dispensing port may advantageously change from a cross-section at which it is coupled to a product supply tube or conduit to a cross-section at which the opposing flaps are connected. Thus, a cylindrical tube (for example) may be used to convey product to the dispensing port and the product dispensing port may have a changing cross-section smoothly, or in discrete steps, change from a cylindrical cross-section to a generally rectangular cross-section.

The product dispensing port may optionally further comprise a pair of opposing product diversion surfaces located on the inside faces of the port perpendicular to the faces supporting the opposing flaps and wherein the diversion surfaces are arranged to divert product falling onto the surfaces towards the centre of the port. Thus, product within the dispensing port can be directed toward the central axis of the port and into the middle of the bag being formed. This advantageously prevents product aggregating at one or more sides of the bag potentially interfering with the gusseting operation. It additionally protects the plastic film from damage as the bag is filled.

The opposing product diversion surfaces may be coupled to the dispensing port by means of suitable hinge arrangement. Thus, opposing product diversion surfaces are moveable from an opened position (generally vertical in orientation) to a closed position (inclined to the vertical). The pivotally mounted diversion surfaces can be conveniently brought together by movement of the upper gusseting members contacting the outer surface of the film enveloping the product dispensing port.

Thus, the two opposing diversion surfaces can pivot into the space defined between the opposing flaps before the opposing flaps themselves pivot together.

Viewed from another aspect there is provided a method of operating a bag forming and filling apparatus as described above comprising the steps of:

A passing a film which envelopes the product dispensing port over and along the outer surface of the product dispensing port by a predetermined distance;

B moving the upper gusseting members towards each other and against the outer surface of the film to cause tension in the film and to draw the opposing flaps inwards and towards each other;

C moving the sealing jaws towards each other so as to contact the outer surface of the film to cause tension in the film and to draw the opposing flaps inwards such that the distal edges of the opposing flaps are proximate to or in contact with each other;

D energising the sealing jaws to transfer energy to the film and to create a seal in the film along the sealing jaw;

E introducing a product into the product dispensing port such that the product falls under gravity onto the opposing flaps;

F optionally cutting through the seal created by the sealing jaws to create a lower end of a bag;

G retracting the gusseting members and the sealing jaws; and

H moving the film vertically downwards over the dispensing port to cause the opposing flaps to move from the closed position to the open position to release the product onto the sealed end of the bag.

Thus, according to a second aspect a method of forming and filling plastic bags is provided which allows for thinner plastic material to be used for a given product and/or a higher production rate to be realised.

The method and apparatus furthermore provides a mechanically reliable arrangement with minimal maintenance and configuration still further increasing productivity and reliability over conventional packaging equipment.

BRIEF DESCRIPTION OF THE DRAWINGS

Embodiment of the invention will now be described by way of example with reference to the following figures.

In accordance with one (or more) embodiments of the present invention the Figures show the following.

Any reference to prior art documents in this specification is not to be considered an admission that such prior art is widely known or forms part of the common general knowledge in the field.

As used in this specification, the words "comprises", "comprising", and similar words, are not to be interpreted in an exclusive or exhaustive sense. In other words, they are intended to mean "including, but not limited to".

The invention is further described with reference to the following examples. It will be appreciated that the invention as claimed is not intended to be limited in any way by these examples.

DETAILED DESCRIPTION

Figure 1:
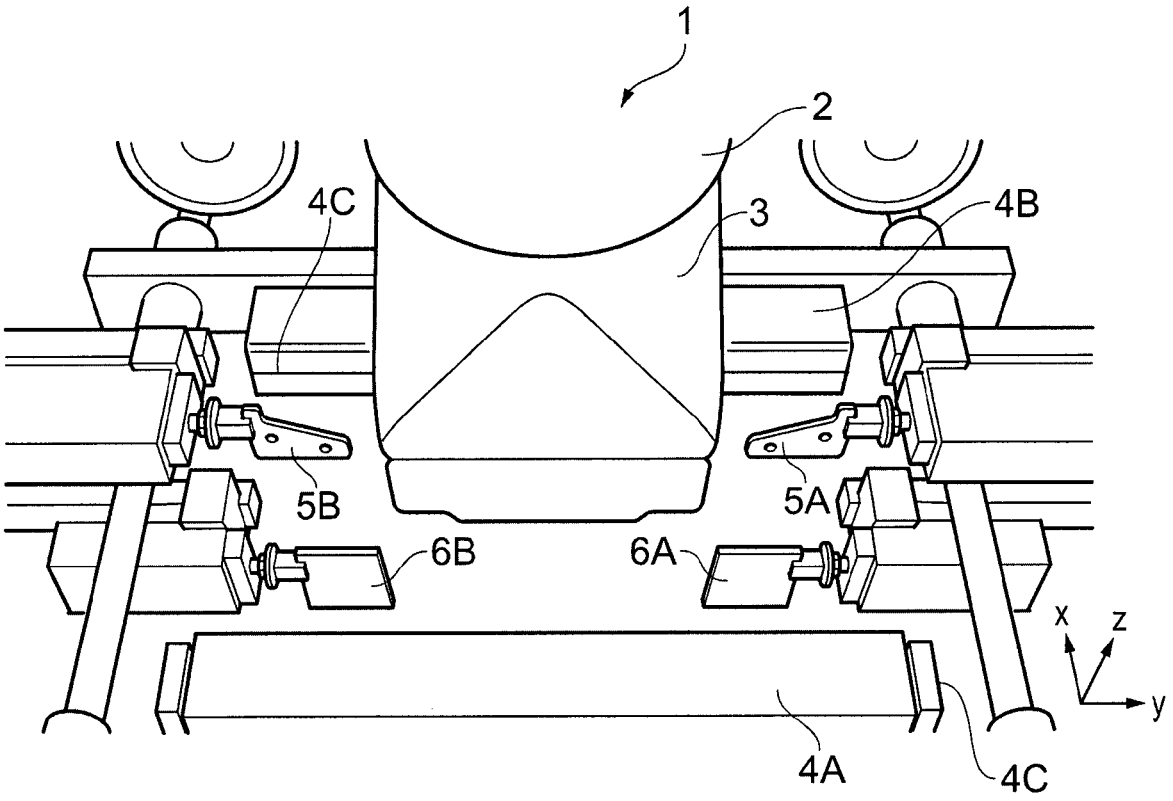
FIG. 1 shows a front view of a packaging machine incorporating a dispensing port of the invention.

FIG. 1 is a view of a packaging machine 1 incorporating an outlet port according to the present invention as viewed from the front of the machine.

The packaging machine is typically, but not exclusively, used for loading breakfast cereals into plastic bags. These packaging machines can operate in a continuous or intermittent mode to form and fill the bags as described in detail below.

An example of a typical cereal product is Shreddies®, manufactured by Nestle®.

The packaging machine comprises a product supply tube 2 which supplies cereal to the packaging machine from a hopper or store (not shown). The product supply tube 2 is connected to the top of the outlet port 3 or 'mouth piece' through which product can be dispensed.

The outlet port is surrounded by actuators which cooperate with a sealing arrangement to form the plastic bag.

Specifically, the packaging machine comprises a pair of opposing sealing jaws 4A, 4B which are movable in the x axis shown in FIG. 1. The sealing jaws incorporate an electrically heated bar which contacts the plastic film material when the two opposing jaws are brought into contact. The sealing jaws also optionally comprise a slot 4C through which a cutting blade (not shown) can extend so as to slide through two joined and adjacent bags (discussed further below).

The machine comprises a first pair of opposing upper gusset blades (or members) 5A, 5B which are movable in the y axis shown in FIG. 1. The machine also comprises a second pair of opposing lower gusset blades (or members) 6A, 6B, again movable in the y axis as shown in FIG. 1.

The actuators are operable using any suitable drive means such as pneumatic cylinders or the like. Such actuators are particularly appropriate for food manufacturing and packaging environments.

Figure 2:
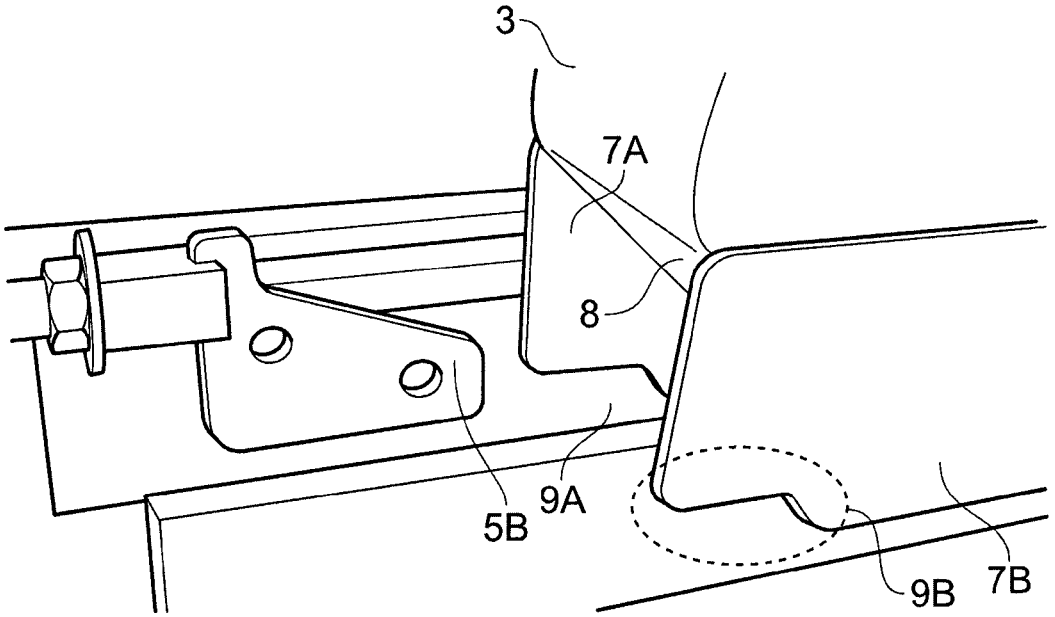
FIG. 2 shows a closer view of one side of the outlet port and associated gusseting blade.

FIG. 2 is a closer view of one of the upper gusseting blades 5B and a partial side view of the lower end of the outlet port 3.

The upper gusseting blades 5A and 5B are mirror images of each other. The blade 5B is coupled to the actuator such that it can move linearly towards the outlet port 3. The blade 5B is in the general shape of a truncated triangle. The upper surface comprises smooth edges such that the plastic film is not damaged as the blade comes into contact with the film in forming a gusset (as described below).

The lower gusset blades (not shown in FIG. 2) may correspond to the upper gusset blades in profile or may be a rectangular shape, again with smoothed or chamfered edges to prevent any damage to the plastic film.

The lower gusset blades have the same function as the upper gusset blades and are used for forming the gusset of the former bag. In addition the tension applied by the lower gusset blades allows forming a continuous channel on both side of longitudinal sides of the bag. Specifically, as the two blades (on each side) move inwards they create a crease in the plastic film running vertically along the centre line between the opposing flaps (described below). This crease forms the side gusset of the bag. One is formed on each side of the bag with a perpendicular seal on each end.

The outlet port 3 comprises a pair of movable opposing flaps 7A, 7B pivotally coupled to the outlet of the dispensing port 3. The opposing flaps have outer surfaces over which the film may pass and inner surfaces arranged to support a cereal (or other product) to be dispensed.

The outlet port 3 also comprises an optional gusset shield 8 which causes cereal product passing through the inside of the outlet port to be deflected towards the central axis of the outlet port 3 as it is dispensed. This may be used depending on the type of cereal or foodstuff being dispensed. This is described below with reference to FIG. 16.

The opposing flaps 7A and 7B are coupled to the body of the outlet port 3 by means of one or more hinge connection arrangements. Thus, the opposing flaps are movable between a first open position in which a product is dispensed and a second closed position in which product is prevented from being dispensed as described below.

The hinge arrangement is such that the outer surface of the opposing flaps is uninterrupted i.e. smooth such that the plastic film material can easily pass over its surface without interfering with a hinge or the like. Thus, the hinge may advantageously be located on the inner surface of the outlet port coupling the respective flaps to the lower edge of the outlet port.

The hinge may be any suitable arrangements and may advantageously be provided with a housing to prevent ingress of foodstuffs into the joints of the hinge. In an alternative arrangement the hinge may be formed of a flexible rubber material sufficiently strong to hold the flap and outlet together whilst also allowing the flap to rotate out the lower edge of the outlet port.

FIG. 2 also shows an optional cut-away section of the flaps 7A and 7B. The cut-away sections 9A and 9B are provided such that when the two opposing flaps are rotated towards each other and the gusseting blade 5B extends towards the flaps, the flaps and blade do not interfere with each other. The cut-away sections provide a space for the blade when in an extended position.

Figure 3A:
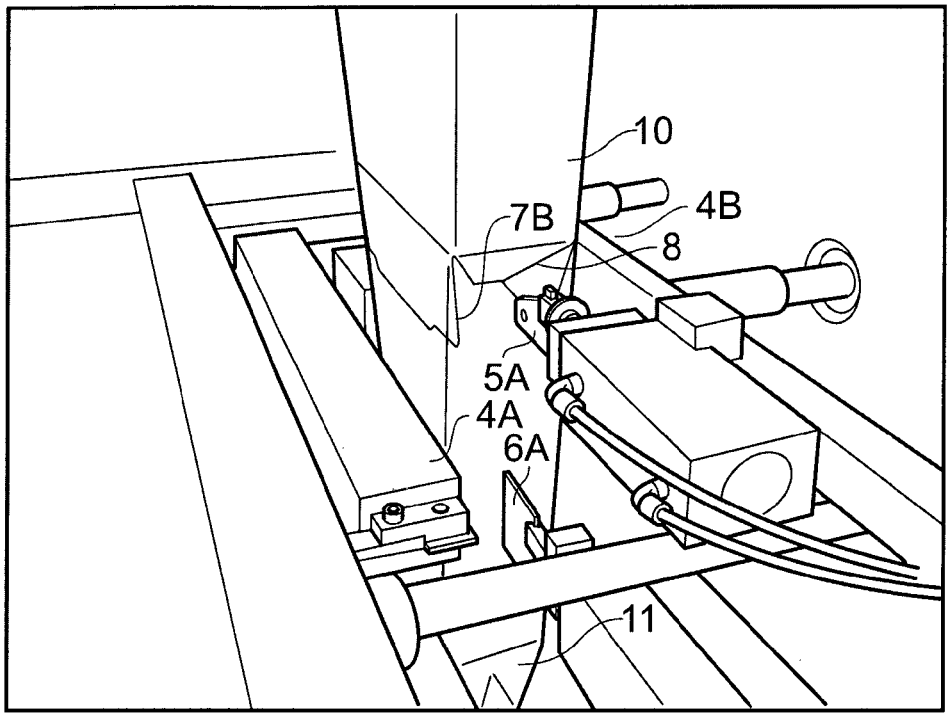
FIG. 3A shows the initial set-up of the packaging machine.

FIG. 3A shows the packaging machine in a state ready to commence packaging of cereal products.

As shown the sealing jaws 4A and 4B are in a retracted position as are the upper and lower gusseting blades 5A, 5B, 6A, 6B. The opposing flaps are also in a generally vertical orientation by virtue of gravity rotating the opposing flaps 7A, 7B about their respective hinges.

The gusseting blades are vertical and centred with respect to the outlet port and centrally aligned with the opposing flaps. The flaps and sealing jaws are positioned such that the lower edge of the flaps in a closed position (described below) is at maximum of 10 mm above a horizontal plane extending between the upper surface of the sealing jaws. Thus, when the sealing jaws are in an extended position and in abutment with one another there is a clearance between the flaps and the sealing jaws.

The distance between the sealing jaws and the lower edge of the flaps in a closed position may vary according to the machine manufacturer.

FIG. 3A also shows the plastic film material 10 that is used to form the plastic bags into which cereal is dispensed.

Any suitable plastic may be used in conjunction with the packaging machine described. The plastic film material can, for example, be made of PE (polyethylene), OPP (oriented polypropylene film) or a metallized plastic film.

Conventional thickness is between 20 and 100 μm. It will be recognised that a machine according to the present invention advantageously allows a thinner plastic to be used for a given cereal product.

The machine is set-up such that a film of plastic envelopes (i.e. surrounds) the outlet port. In effect a tube or sheath of plastic surrounds the outlet port as well as the opposing flaps 7A, 7B. As can be seen, the opposing flaps are in a substantially vertical position.

As shown in FIG. 3A the plastic tube extends around the outlet and flaps and continues vertically down and out of the bottom of the machine. FIG. 3A also shows a preformed gusset and seal 11. FIG. 3A also illustrates the previous seal and gusset from the previous bag. In operation the gusseting and sealing action creates the top and bottom seals of adjacent bags in the sequence. The pre-formed gusset and seal 11 correspond to the bag previously formed and that the lower gusset will be used to form the gusset on the upper part of the bag previously formed.

Figure 3B:
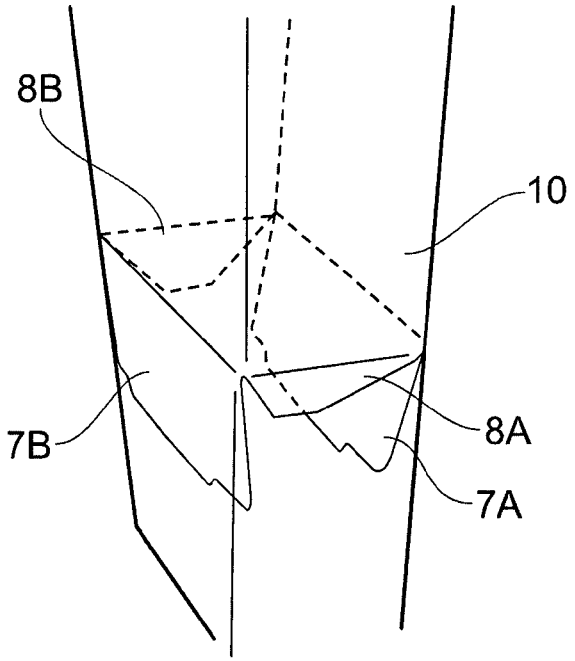
FIG. 3B shows the outlet port, opposing flaps and diversion shields with the enveloping plastic.

FIG. 3B shows the plastic material 10 enveloping the outlet port. FIG. 3B specifically illustrates the positions of the opposing flaps 7A, 7B and gusseting shields 8A, 8B in an open position i.e. before the bag is formed and filled. Only part of the product dispensing port with outlet port 3 is represented for ease of clarity in the figure.

The operation of the packaging machine will now be described.

Figure 4:
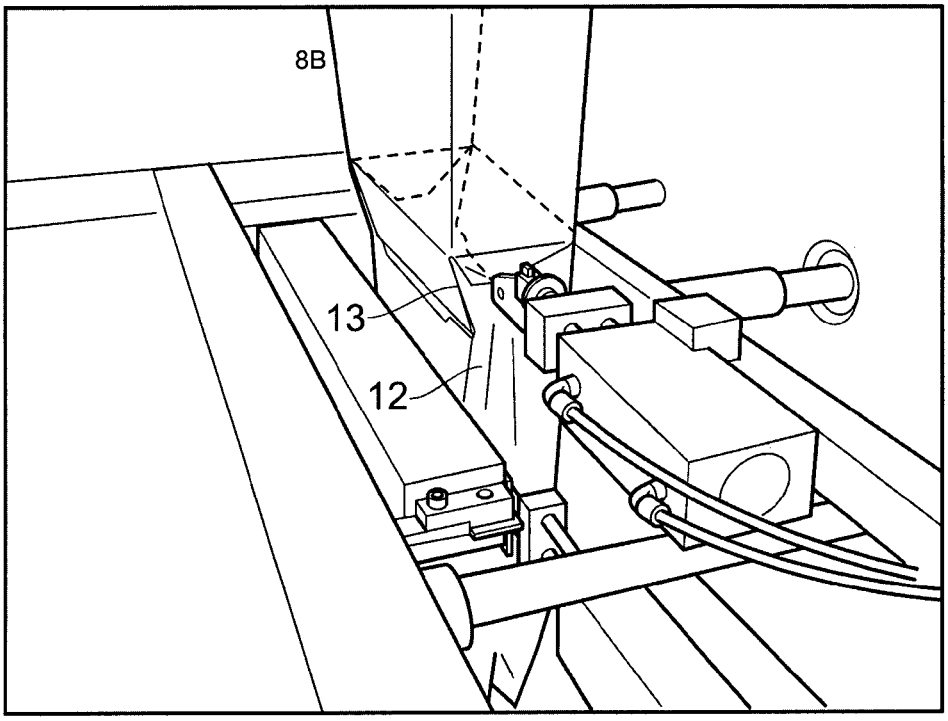
FIGS. 4 to 12 show the successive steps of the bag forming and filling operation according to the apparatus and method of the invention.

Referring to FIG. 4, the four actuators connected to the respective gusseting blades are activated and the four blades begin to move axially towards the plastic film enveloping the outlet port and extending vertically directly in front of the blades.

As shown in FIG. 4 the distal ends of each gusseting blade contacts the outer surface of the plastic films. Continued axial extension of the blades causes the film to be drawn inwards towards a centre line of the outlet port. Crease lines 12 of the film 10 are illustrated in FIG. 4.

Simultaneously the sealing jaws (back and front) begin to move towards each other and the plastic film.

The opposing flaps 7A and 7B are rotatably coupled to the lower edges of the outlet port and movement of the gusseting blades draws the plastic film inwards which in turn causes the rotatably mounted opposing flaps to begin to move from a vertical position to an inclined of angle orientation with respect to the vertical axis. This is illustrated in FIG. 4 where the opposing flaps begin to move 13.

Figure 5:
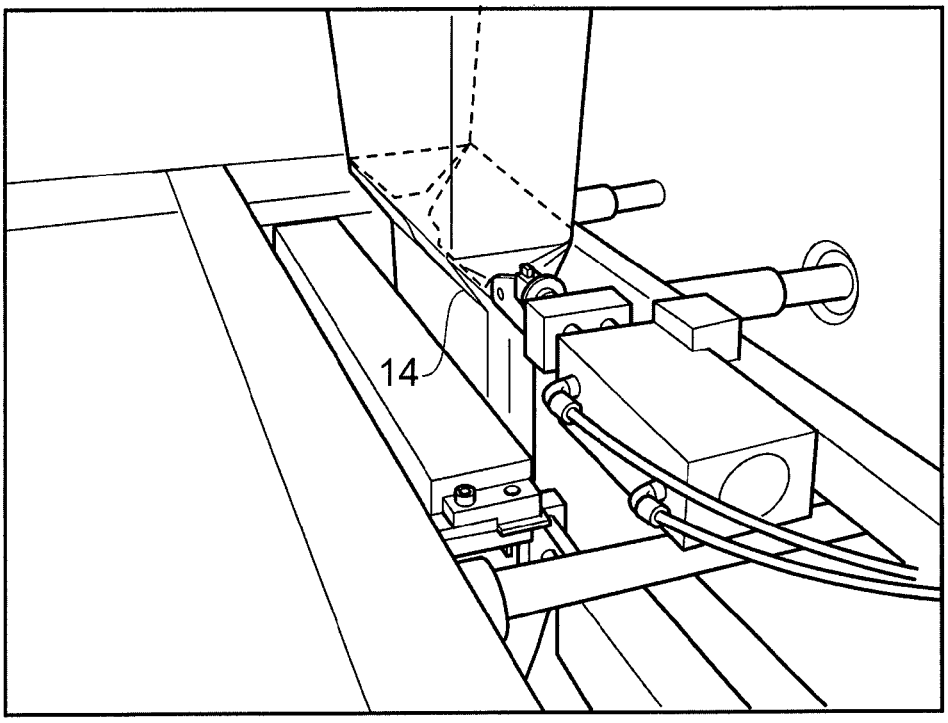

FIG. 5 shows the next stage of the bag forming and filling process.

Here the blades continue to extend and cause the plastic film to be drawn in further. Correspondingly the opposing flaps are also drawn in to an increasing angle with respect to the vertical by virtue of the plastic film enveloping them and the outlet port. Put another way, the gusseting blades cause tension in the plastic film which draws the film against the outer surface of the opposing flaps. As illustrated in FIG. 5 the opposing flaps are still further inclined with respect to the vertical 14. Simultaneously the sealing jaws continue to move towards each other.

Figure 6:
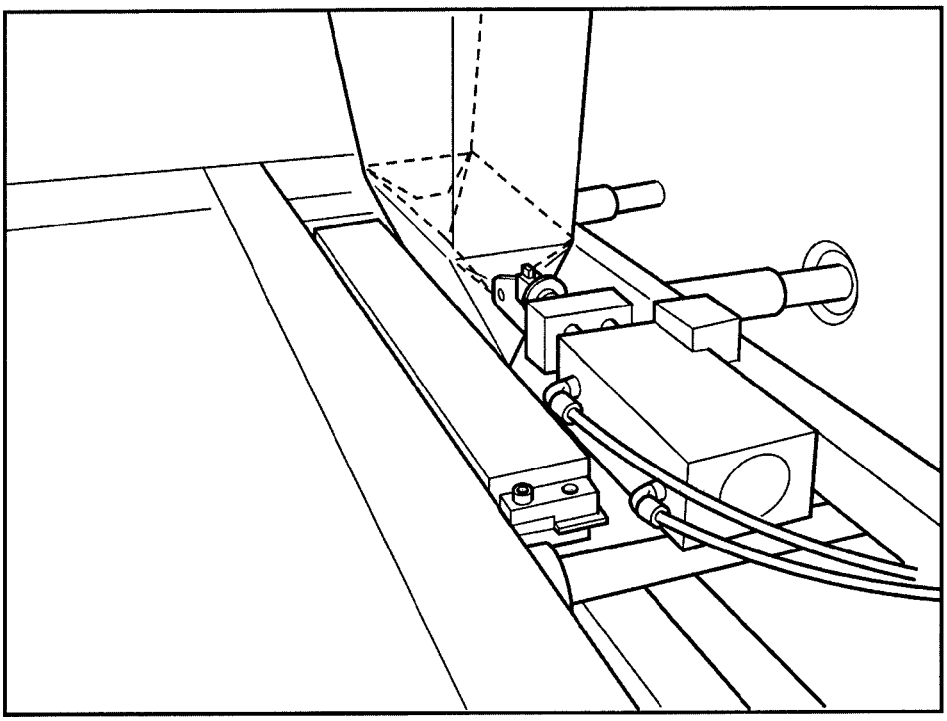

FIG. 6 shows the gusseting blades fully extended. The resulting shape of the plastic film is the gusset shape for the plastic bag into which the cereal can be dispensed.

It will be recognised that the precise shape of the gusset is determined by the shape and movement of the gusseting blades.

In the position shown in FIG. 6 the opposing flaps are not fully closed but have been drawn in by virtue of the tension in the film as described above.

Figure 7:
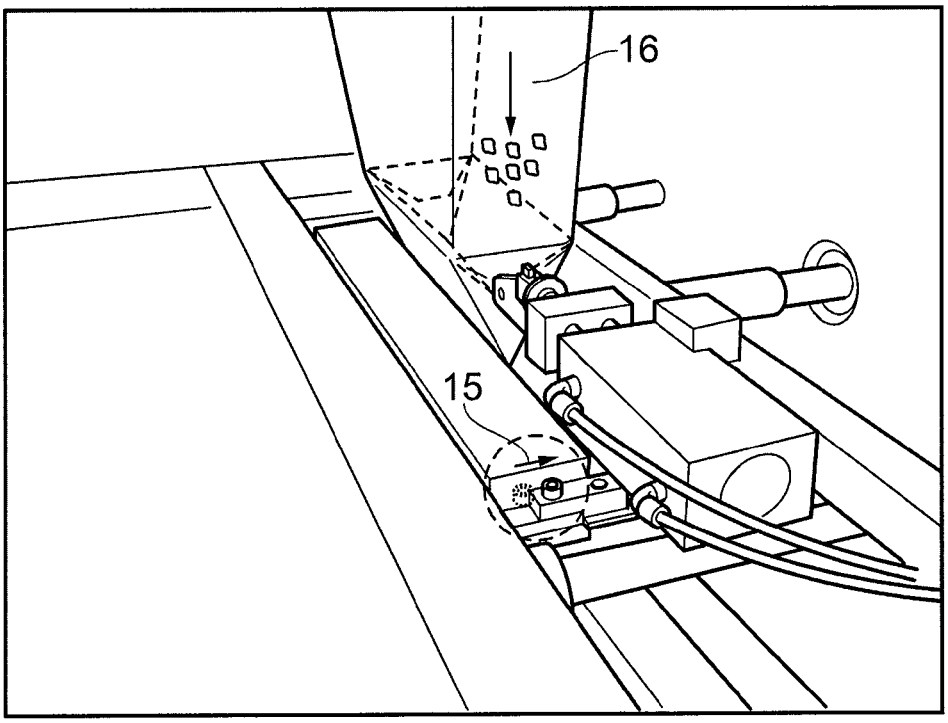

FIG. 7 illustrates the next stage in bag forming. Here, the gusseting blades are retained in an extended position and in contact with the plastic film. The sealing jaws continue to move as shown by arrow 15 and eventually reach their end positions where they are in abutment with one another. As the sealing jaws move together they contact the plastic film on a side perpendicular to the contact made by the gusseting blades.

As the sealing jaws move together they cause the two opposing sides of the plastic film to be brought together and sandwiched between the opposing sealing jaws. This movement causes further tension in the plastic film which brings the two opposing flaps into their final position. The distal edges of the each opposing flap (that is distal from the hinged edge of the respective flap) is either proximate to or in contact with the opposing edge of the opposing flap. This is described further below with reference to FIGS. 13 to 15.

The sealing jaws include a heated portion which is in contact with the plastic film. This heated portion is activated and heat is transferred to the plastic film causing the two opposing sides of the plastic film to be melted and bonded together. Because the sealing jaws are sufficiently long to extend along the entire width of the plastic film a continuous seal is created. Thus, a lower end seal of a plastic bag is formed.

With the sealing jaws and gusseting blades in a fully extended position the opposing flaps are in close proximity to each other and provide a V shaped bottom at the outlet to the outlet port. Importantly the V shape formed by the hinged opposing flaps is positioned within the end of the plastic bag i.e. the seal described above is located on the outside of the bag.

With the opposing flaps forming a V shape bottom to the outlet port the plastic film (and the seal now formed at the end of the bag) is shielded by the upper and inner surfaces of the opposing flaps.

The next stage is to release the cereal product from the supply tube 2 into the outlet 3. Gravity causes the cereal flakes 16 to fall into the bag and onto the inner and upper surface of the opposing flaps. The cereal flakes impact the opposing flaps instead of the plastic film. The plastic film is thereby protected while the dispensing port is filled with a predetermined quantity of cereal product.

Optionally a blade positioned with one of the sealing jaws is activated and caused to cut through part of the sealed portion of the end of the bag. This separates a previously formed and filled bag from the bag presently in the machine.

The sealing jaws remain in position for a predetermined period of time so as to create a resilient seal.

Figure 8:
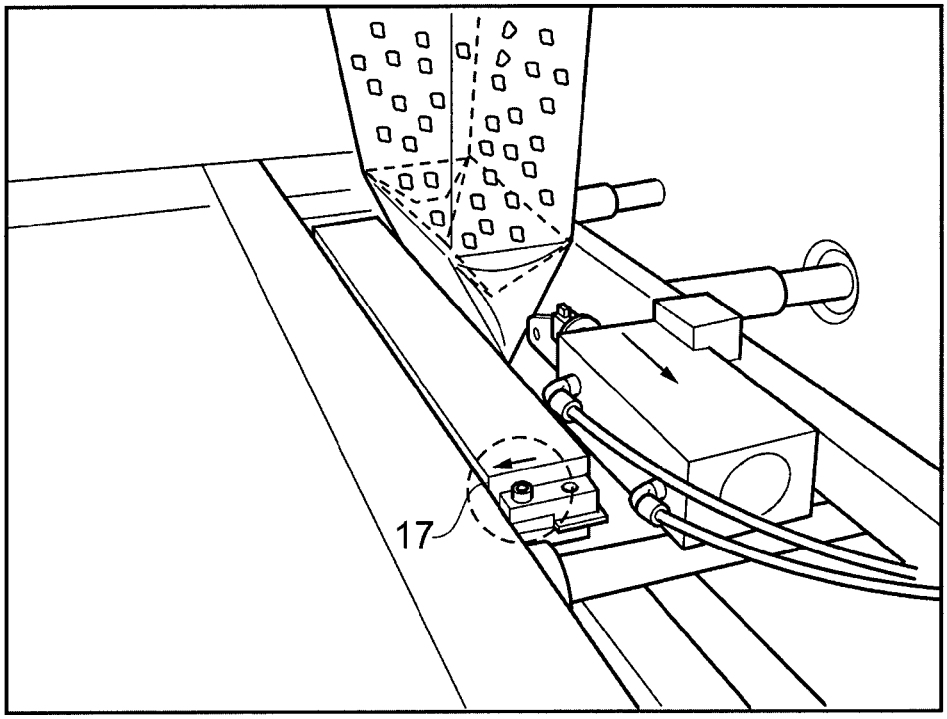
Figure 9:
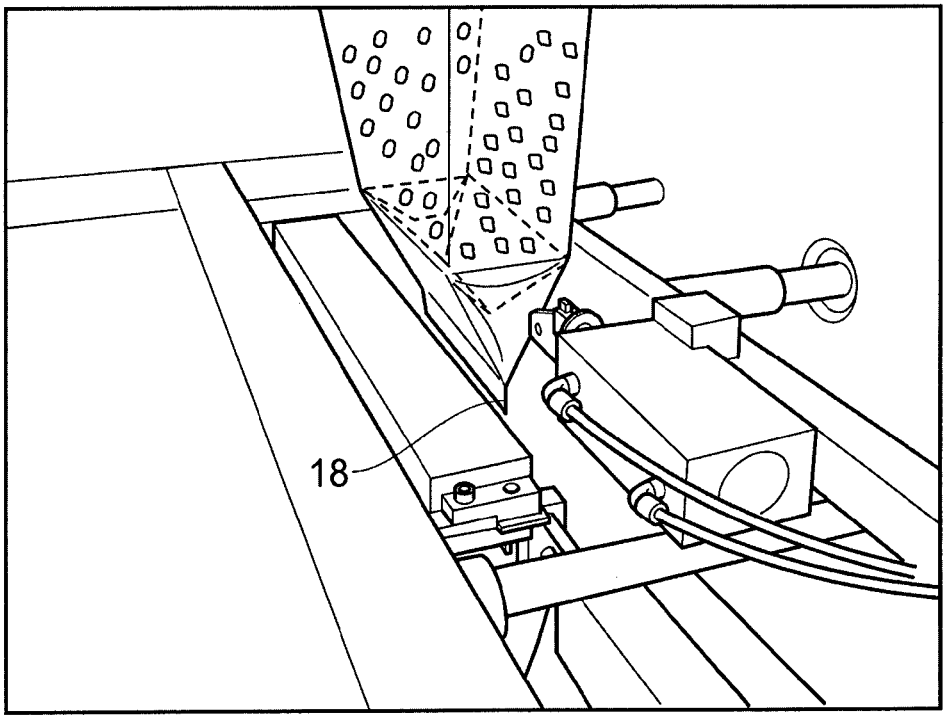

The process then continues with the retraction of the gusseting blade first followed by retraction of the sealing jaws after. The film tube is then moved downwards and the cereal products fall down from the inner and upper surface of the opposing flaps into the bottom of the bag as the opposing flaps come back to an open position FIG. 8 shows the retraction of the sealing jaws and the gusseting blades into their start positions and FIG. 9 illustrates the formed and cut seal 18 at the bottom of the plastic film.

Figure 10:
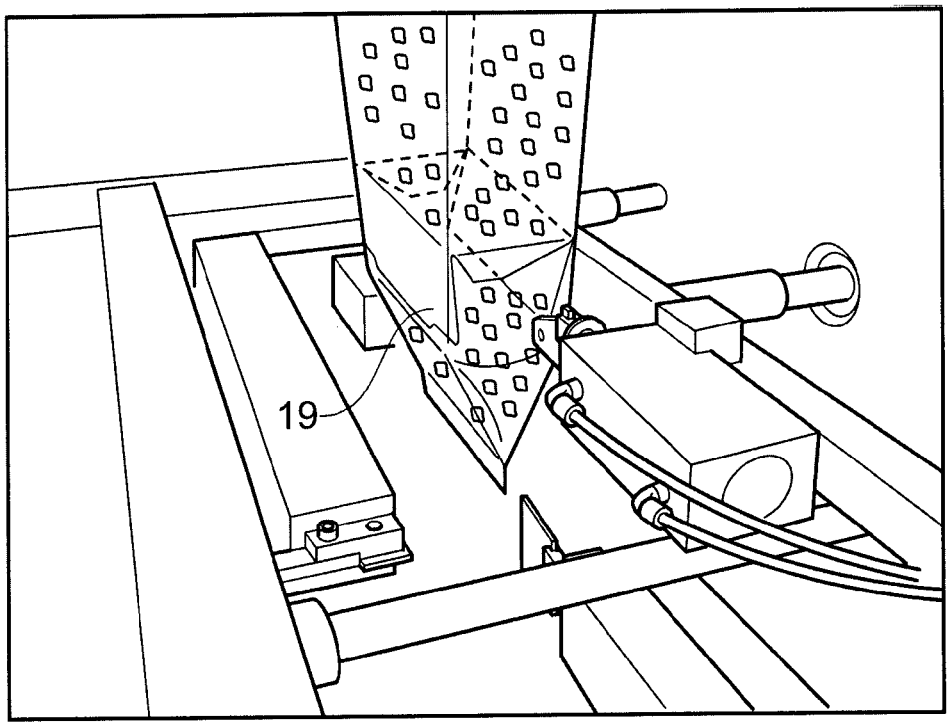
Figure 11:
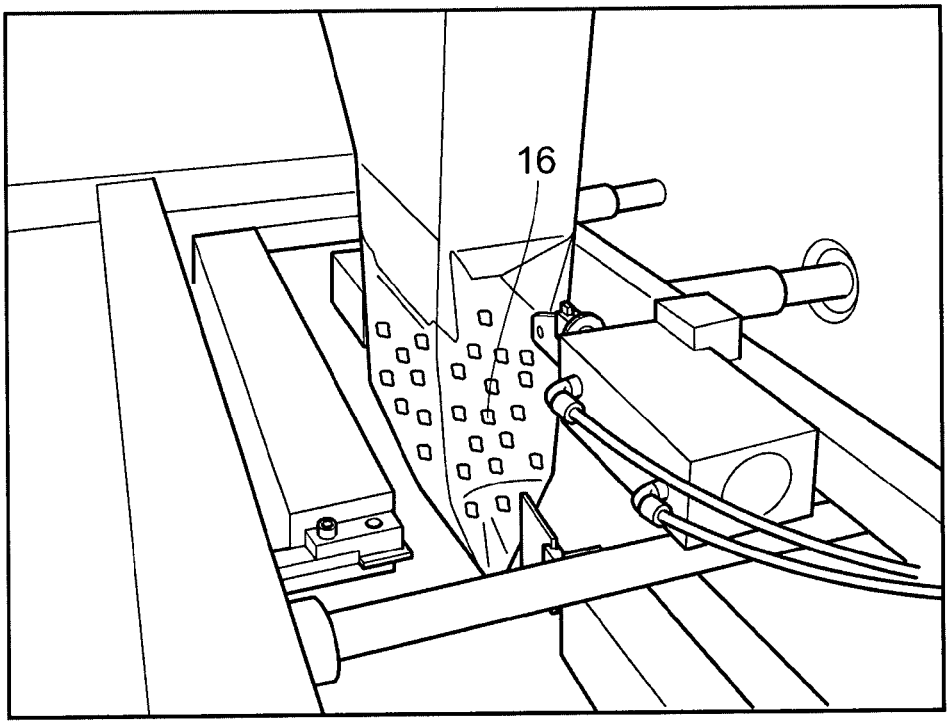

FIGS. 10 and 11 show the bag movement once the sealing jaws and gusseting blades have been retracted and cereal 16 contained in the bag. Here the plastic film surrounding the outlet port is allowed to move vertically downwards as shown between FIGS. 10 and 11. FIG. 10 is shown without cereal 16 but illustrates how movement of the plastic film allows the opposing flaps 19 to return to their vertical orientation. Movement of the bag downwards moves the V shaped end of the bag (formed by the gusset and seal) vertically away from the opposing flaps which allows them to rotate back into their start positions as shown in FIGS. 10 and 11.

Figure 12:
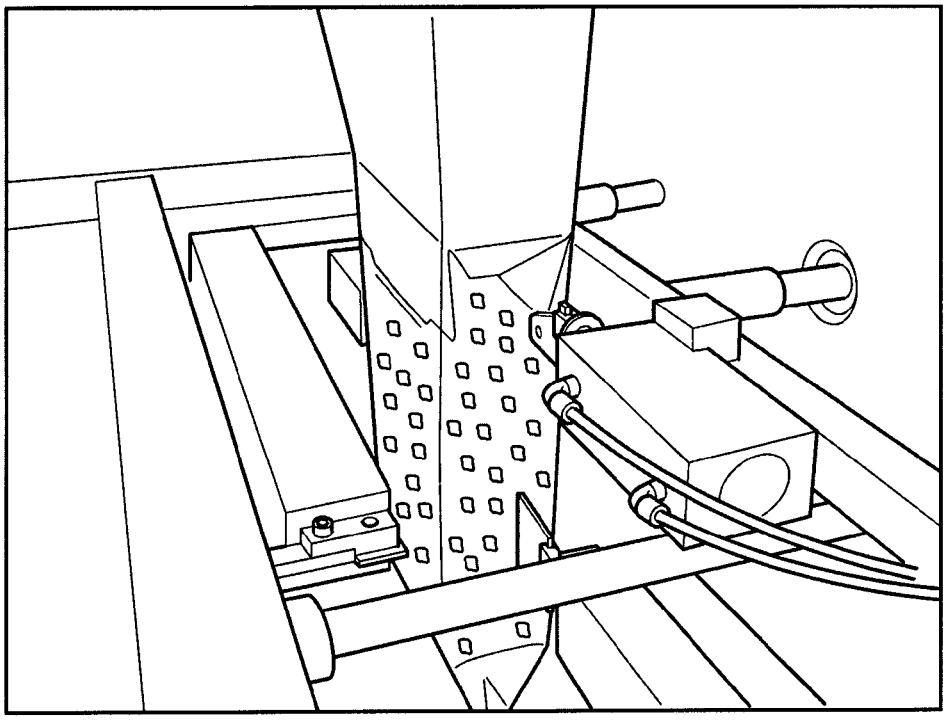

FIG. 12 shows the bag moving down by a predetermined distance corresponding to the desired length of the bag. This returns the machine to its start position (see comparison of FIGS. 1 and 12) and the process can then be repeated.

The process can then run continuously forming and filling bags in a continuous repeating cycle as described with reference to FIGS. 1 to 12.

Figure 13:
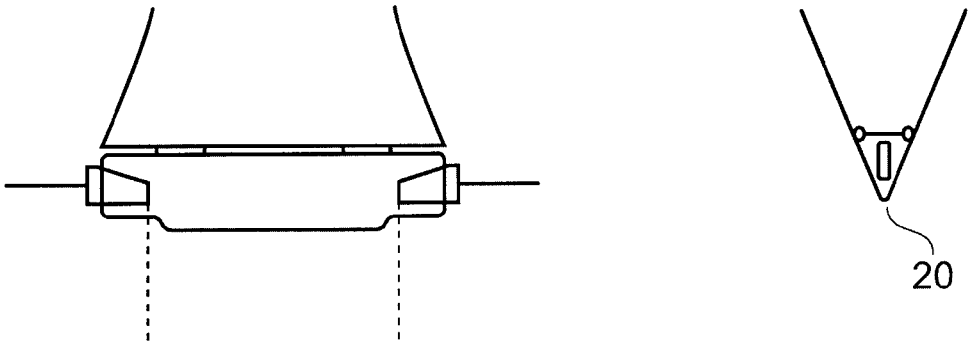
FIGS. 13 and 14 show alternative arrangements for the opposing flaps of the invention.
Figure 14:
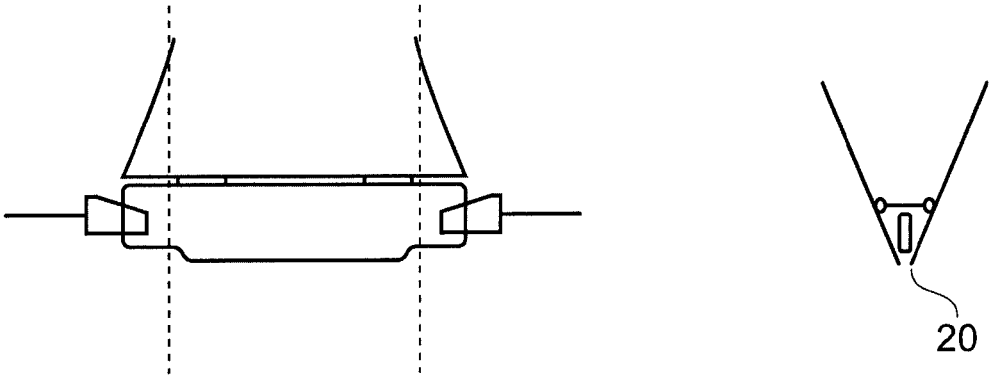
Figure 15:
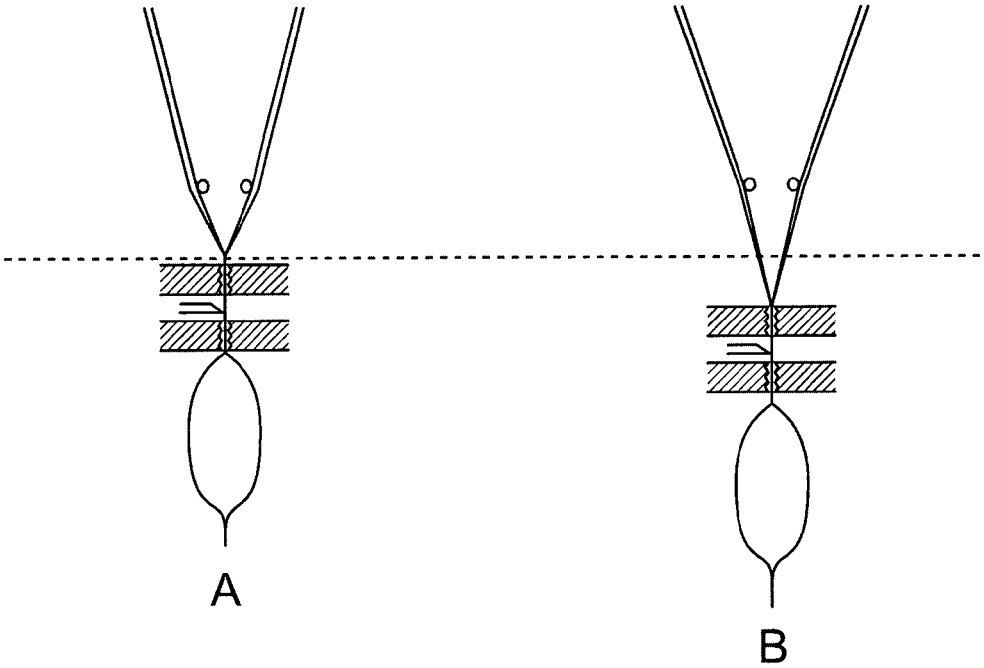
FIG. 15 shows the relative position of the sealing jaws with respect to the opposing flaps.

FIGS. 13 to 15 illustrate the relative positioning of the distal edges of the opposing flaps in two embodiments.

The first embodiment is shown in FIG. 13 where the distal edges 20 of the opposing flaps are in contact. The second embodiment is shown in FIG. 14 where the distal edges 20 of the opposing flaps are proximate one another but not in contact.

The embodiment of FIG. 13, where the flaps are fully closed and in contact, advantageously allows for a reduction in dust in and around the seal form by the sealing jaws. Additionally, it prevents contamination in the seal which might be detrimental to the integrity of the seal and thus the life-span of the product. It is furthermore advantageous when the food product is in the form of a powder or very fine granules.

In the embodiment of FIG. 14 the flaps are proximate to each other and define a space or separation therebetween i.e. they are not in contact. This may be used for larger food products. The space between the opposing flaps may be selected with respect to the size of the food products to be packaged. For example the spacing may be selected to be just smaller than the size of a food product. Thus, the food product can be prevented from impacting the plastic bag since it cannot pass between the opposing flaps whilst not requiring the flaps to be fully closed.

With reference to FIG. 15 the selection of each contact or proximate positioning of the distal edges depends on the location of the sealing jaws with respect to the bottom of the flaps. If the sealing jaws are moved close to the opposing flaps as shown in FIG. 15A then the opposing flaps will be brought into contact as shown in FIG. 13.

Conversely if the sealing jaws are located away from the opposing flaps as shown in FIG. 15B then the distal edges are proximate each other as shown in FIG. 14.

FIG. 15 also illustrates the optional cutting blade located within one of the sealing jaws. The cutting blade may be extended to cut and separate adjacent bags that have been formed.

Figure 16:
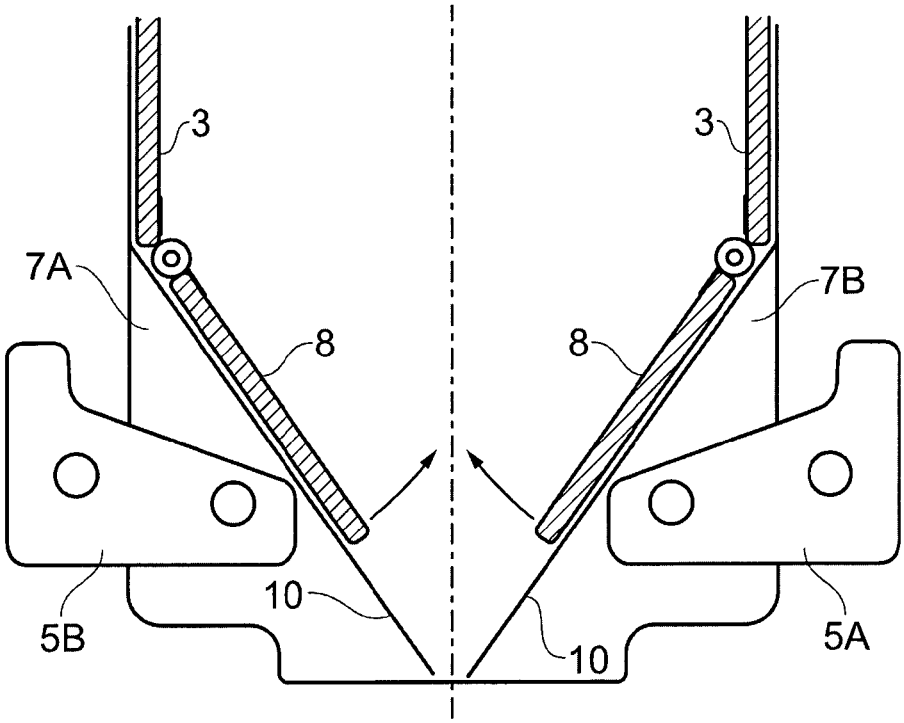
FIGS. 16 and 17 show the hinge arrangement and movement of the gusset shields and opposing flaps respectively.
Figure 17:
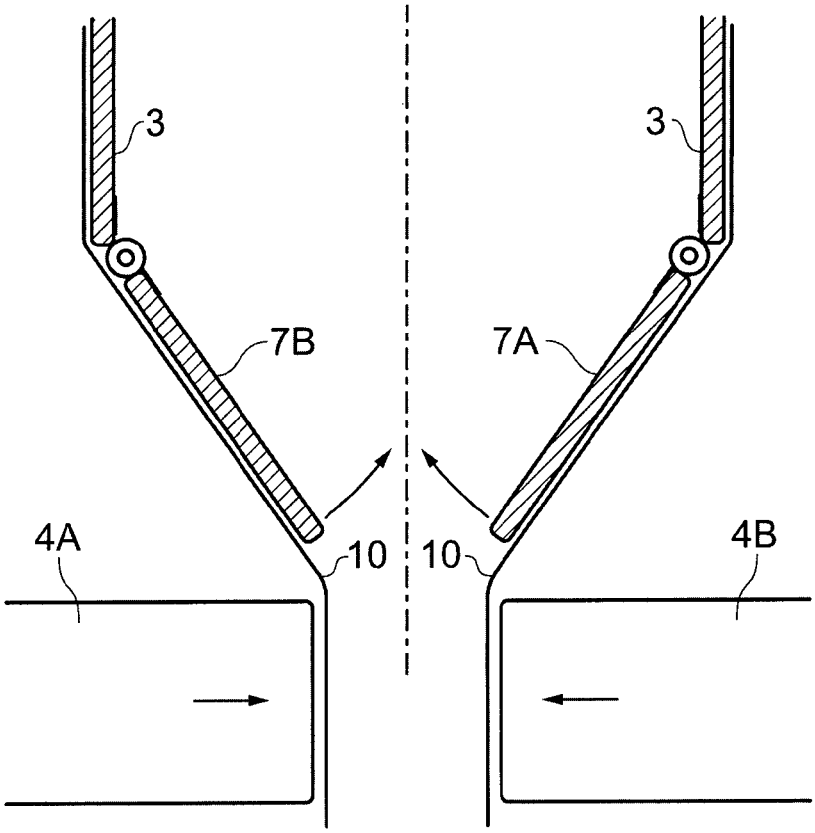

FIGS. 16 and 17 further illustrate the produce diversion shields (and their rotation) and the opposing flaps (and their rotation) respectively.

With reference to FIG. 16, and as describe above, the outlet port 3 comprises an optional gusset shield 8 which deflects cereal towards the central axis of the outlet port 3 as it is dispensed. This may be used depending on the type of cereal or foodstuff being dispensed.

The diversion shield or gusset shield 8 can be seen in FIG. 16 connected to the outlet port 3 by a hinge located therebetween. FIG. 16 is a cross-section and the opposing flap 7A is visible behind the gusset blades 5A and 5B. The plastic film 10 can be seen against the outer surface of the outlet port. As illustrated, as the gusseting blades move together they contact the film and apply a force in opposing directions to a respective gusset shield. The gusset shields then rotate into the space between the opposing flaps. As can further be seen from FIG. 16 the gusset shield then protect the plastic material forming the gusset from damage as cereal products are dropping into the bag.

Alternatively, in another embodiment, the gusset shield may be fixed to the outlet port and may not be rotatably mounted. In such an embodiment the gusset shield is fixed at an angle such that it does not interfere with the gusseting blade as it extends.

For completeness FIG. 17 illustrates the corresponding coupling of the opposing flaps to the outlet port. As shown flaps 7A and 7B are coupled to the outlet port 3 by means of a hinge therebetween.

Movement of the opposing sealing jaws 4A, 4B beneath the opposing flaps causes tension in the plastic material 10 and causes the opposing flaps to rotate about the hinges.

The movement in FIG. 16 occurs first so as to generate the elongate crease of the gusset (extending along each side of the bag) and the opposing flap movement in FIG. 17 then occurs to create the end of the bag and the seal.

According to the invention there is provided an improved packaging machine.

Specifically the rotatably mounted opposing flaps at the outlet of port allow the machine to maintain a high level of quality of the back while using plastic film of conventional thickness because the flap arrangements protects the plastic material from damage caused by impact with cereal (or indeed other food products).

Such arrangement of opposing flaps allows envisaging reduction of plastic film thickness.

The machine according to the invention is particularly advantageous where cereal flakes are sharp or have angled edges.

Although the invention has been described by way of example, it should be appreciated that variations and modifications may be made without departing from the scope of the invention as defined in the claims. Furthermore, where known equivalents exist to specific features, such equivalents are incorporated as if specifically referred in this specification.

As a concrete example, the proposed product dispensing port may be used for food products in the form of powder like coffee powder or chocolate powder, or small agglomerate like instant coffee or tea.

The invention claimed is:

1. A bag forming and filling apparatus comprising:

a product dispensing port having (i) an outer surface over which a film enveloping the product dispensing port may pass and (ii) an inner passage through which a product may be dispensed, the product dispensing port further comprises a pair of opposing flaps pivotally coupled to an outlet of the dispensing port, the pair of opposing flaps having outer surfaces over which the film may pass and inner surfaces arranged to support the product to be dispensed, and the opposing flaps are movable between a first open position in which the product is dispensed and a second closed position in which the product is prevented from being dispensed, the opposing flaps are coupled to the product dispensing port by a hinge arrangement such that rotation of each respective flap brings distal edges of each flap together in the second closed position, each opposing flap is rectangular having (a) a first edge proximal the hinge and rotatably coupled to the product dispensing port and (b) a second distal edge opposed to the first edge and arranged to move in an arc towards the opposing flap, and the second opposing distal edge has a central substantially straight region and two truncated regions at either end of the second distal edge; and a bag gusseting and sealing arrangement proximate a vertically lower outlet of the product dispensing port and arranged to selectively engage with an outer surface of the film enveloping the product dispensing port.

2. The bag forming and filling apparatus of claim 1, wherein the bag gusseting and sealing arrangement comprises a pair of horizontally movable upper gusseting members movable from a retracted position to an extended position wherein distal portions of each member are positioned between the opposing flaps.

3. The bag forming and filling apparatus of claim 2, wherein the pair of horizontally movable upper gusseting members are arranged to move towards each other simultaneously and to contact the outer surface of the film to cause the film enveloping the opposing flaps to be drawn inwards and against the outer surfaces of the opposing flaps.

4. The bag forming and filling apparatus of claim 3, wherein the bag gusseting and sealing arrangement further comprises a pair of opposing and horizontally movable elongate sealing jaws arranged to move from a first retracted position to a second extended position in which the opposing and horizontally movable elongate sealing jaws are in abutment with each other.

5. The bag forming and filling apparatus of claim 4, wherein the pair of opposing and horizontally movable elongate sealing jaws is arranged to move together in opposing directions to contact the outer surface of film and to cause the film enveloping the opposing flaps to be drawn inwards and against the outer surfaces of the opposing flaps.

6. The bag forming and filling apparatus of claim 5, wherein an upper surface of the opposing and horizontally movable elongate sealing jaws is in a plane vertically beneath lower edges of the opposing flaps in the second closed position.

7. The bag forming and filling apparatus of claim 4 wherein the direction of movement of the pair of opposing and horizontally movable elongate sealing jaws is perpendicular to the direction of movement of the horizontally movable upper gusseting members.

8. The bag forming and filling apparatus of claim 1, wherein the two truncated regions are arranged to receive a portion of a gusseting member when the gusseting member is in a gusset forming position and when the opposing flaps are in the second closed position.

9. The bag forming and filling apparatus of claim 1, wherein the outlet of the product dispensing port is rectangular in cross-section.

10. A bag forming and filling apparatus comprising:

a product dispensing port having (i) an outer surface over which a film enveloping the product dispensing port may pass and (ii) an inner passage through which a product may be dispensed, the product dispensing port further comprises a pair of opposing flaps pivotally coupled to an outlet of the dispensing port, the pair of opposing flaps having outer surfaces over which the film may pass and inner surfaces arranged to support the product to be dispensed, and the opposing flaps are movable between a first open position in which the product is dispensed and a second closed position in which the product is prevented from being dispensed, the product dispensing port further comprises a pair of opposing product diversion surfaces located on inside faces of the product dispensing port perpendicular to faces supporting the opposing flaps, and the pair of opposing product diversion surfaces are arranged to divert the product falling onto surfaces towards a centre of the product dispensing port; and a bag gusseting and sealing arrangement proximate a vertically lower outlet of the product dispensing port and arranged to selectively engage with an outer surface of the film enveloping the product dispensing port.

11. The bag forming and filling apparatus of claim 10, wherein the opposing flaps are coupled to the product dispensing port by a hinge arrangement such that rotation of each respective flap brings distal edges of each flap together in the second closed position.

12. The bag forming and filling apparatus of claim 11, wherein each opposing flap is rectangular having (a) a first edge proximal the hinge and rotatably coupled to the product dispensing port and (b) a second distal edge opposed to the first edge and arranged to move in an arc towards the opposing flap.

13. The bag forming and filling apparatus of claim 10, wherein the opposition product diversion surfaces are coupled to the product dispensing port by a hinge arrangement, the opposition product diversion surfaces being moveable from an opened position to a closed position upon upper gusseting members contacting the outer surface of the film enveloping the product dispensing port.

14. A method of operating a bag forming and filling apparatus comprising:

passing a film which envelopes a product dispensing port of the bag forming and filling apparatus over and along an outer surface of the product dispensing port by a predetermined distance;

moving upper gusseting members of the bag forming and filling apparatus towards each other and against an outer surface of the film to cause tension in the film and to draw opposing flaps of the product dispensing port inwards and towards each other;

moving sealing jaws towards each other to contact the outer surface of the film to cause tension in the film and to draw the opposing flaps of the product dispensing port inwards such that distal edges of the opposing flaps are proximate to or in contact with each other;

energizing the sealing jaws to transfer energy to the film and to create a seal in the film along the sealing jaws;

introducing a product into the product dispensing port such that the product falls under gravity onto the opposing flaps;

retracting the upper gusseting members and the sealing jaws; and moving the film vertically downwards over the product dispensing port to cause the opposing flaps to move from a closed position to an open position to release the product onto a sealed end of a bag, wherein the opposing flaps are coupled to the product dispensing port by a hinge arrangement such that rotation of each respective flap brings distal edges of each flap together in the second closed position, each opposing flap is rectangular having (a) a first edge proximal the hinge and rotatably coupled to the product dispensing port and (b) a second distal edge opposed to the first edge and arranged to move in an arc towards the opposing flap, and the second opposing distal edge has a central substantially straight region and two truncated regions at either end of the second distal edge.

15. The method of claim 14, wherein the two truncated regions are arranged to receive a portion of the upper gusseting member when the upper gusseting member is in a gusset forming position and when the opposing flaps are in the closed position.

16. A method of operating a bag forming and filling apparatus comprising:

passing a film which envelopes a product dispensing port of the bag forming and filling apparatus over and along an outer surface of the product dispensing port by a predetermined distance;

moving upper gusseting members of the bag forming and filling apparatus towards each other and against an outer surface of the film to cause tension in the film and to draw opposing flaps of the product dispensing port inwards and towards each other;

moving sealing jaws towards each other to contact the outer surface of the film to cause tension in the film and to draw the opposing flaps of the product dispensing port inwards such that distal edges of the opposing flaps are proximate to or in contact with each other;

energizing the sealing jaws to transfer energy to the film and to create a seal in the film along the sealing jaws;

introducing a product into the product dispensing port such that the product falls under gravity onto the opposing flaps;

retracting the upper gusseting members and the sealing jaws; and moving the film vertically downwards over the product dispensing port to cause the opposing flaps to move from a closed position to an open position to release the product onto a sealed end of a bag, wherein the product dispensing port comprises a pair of opposing product diversion surfaces located on inside faces of the product dispensing port perpendicular to faces supporting the opposing flaps, and the pair of opposing product diversion surfaces are arranged to divert the product falling onto surfaces towards a centre of the product dispensing port.

17. The method of claim 16, wherein the opposition product diversion surfaces are coupled to the product dispensing port by a hinge arrangement, the opposition product diversion surfaces being moveable from an opened position to a closed position upon the upper gusseting members contacting the outer surface of the film enveloping the product dispensing port.

* * * * *